United States Patent [19]

Scizak

[11] Patent Number: 4,736,556

[45] Date of Patent: Apr. 12, 1988

[54] HOUSING ARRANGEMENT

[76] Inventor: William A. Scizak, 2213 Comistas Dr., Walnut Creek, Calif. 94598

[21] Appl. No.: 938,663

[22] Filed: Dec. 5, 1986

[51] Int. Cl.[4] ..... E04H 1/00

[52] U.S. Cl. ..... 52/169.2; 52/236.3; 52/169.3

[58] Field of Search ..... 52/169.2, 169.3, 169.4, 52/236.3

[56] References Cited

U.S. PATENT DOCUMENTS

| | | | |
|---|---|---|---|
| 3,427,645 | 2/1969 | Sproul | 52/169 |
| 3,732,649 | 5/1973 | Mehran | 52/169.3 |
| 3,874,137 | 4/1975 | Gentry | 52/169 |
| 4,345,407 | 8/1982 | Fishman | 52/169.3 |

FOREIGN PATENT DOCUMENTS

| | | | |
|---|---|---|---|
| 585731 | 10/1959 | Canada | 52/236.3 |

*Primary Examiner*—James L. Ridgill, Jr.
*Attorney, Agent, or Firm*—Townsend & Townsend

[57] ABSTRACT

A housing arrangement in two columns of lots with a staggered configuration such that all the houses in the lots may face in the same direction so as to take advantage of ambient conditions while simultaneously providing optimum land-use efficiency and privacy for the occupants of every lot in their dwellings and back yards. The configuration of structures also provide numerous advantages such as security, noise buffering, avoidance of visual pollution, convenient access to the back yard, ability to change columnar direction to follow the geographic and physical contours of the area, and ease of placement of utility lines and passive solar devices.

9 Claims, 3 Drawing Sheets

HOUSING ARRANGEMENT

FIELD OF THE INVENTION

The present invention relates generally to housing arrangements and more particularly to a multi-unit housing arrangement wherein the lots, dwellings, garages and courtyards are disposed so that land-use efficiency is achieved while preserving each unit's access to light and air.

BACKGROUND OF THE INVENTION

Increasing populations in desirable communities have resulted in higher density living and the concomitant problems of privacy, noise, and access to light and air for individual living units. Attempts have been made to arrange multiple housing units to maximize efficiency of land-use while still providing some privacy, access to light and air, and noise and visual pollution abatement for individual homes. For privacy and to abate noise and visual pollution, Fishman, U.S. Pat. No. 4,345,407, arranged several housing units around a courtyard with living and sleeping areas facing the courtyard and service areas such as bathrooms, storage rooms and garages facing the sources of noise and visual pollution. For access to light and air, Sproul, U.S. Pat. No. 3,427,645, exposed more dwelling side wall by means of an oblique arrangement of lots and dwellings, resulting in a psychological feeling of spaciousness.

For almost complete privacy, individual courtyards enclosed by a house, garage and fence are disclosed by Gentry, U.S. Pat. No. 3,874,137, Gentry has arranged lots in rows and columns. There are two lots per row and a multiplicity of lots stacked one upon the other per column. Two columns are contiguous. The back edges of the lots of a row face each other at a common back edge. The front edges of the lots of each column and each row face public streets. The back yard of a given lot is enclosed on one side by a side wall of the next-door neighbor's house and to achieve privacy for that yard, there are no windows in the side wall so the next-door neighbor cannot view that back yard. The opposite side of the back yard is enclosed by the side wall of the house on the given lot and has windows opening up on the resident's own yard. Total privacy for the back yard is achieved by completing the enclosure of the back yard with the back garage wall on the given lot and the windowless back wall of the back yard neighbor's house in the other column. This arrangement then requires that the walls with windows facing a house's own back yard must face in one direction and, consequently, the walls with windows facing a house's own back yard in the other column of houses must face in the opposite direction. Thus, in Gentry's arrangement, if the houses in one column have the side wall windows receiving, for example, southern exposure, then the houses in the other column cannot receive that southern exposure. Similarly, the windowless side walls in this arrangement cannot be made to all face the source of, say, cold winds or noise pollution.

In summary, the prior art does not allow the side walls with windows of houses in parallel columns to all face the same direction to take advantage of local conditions while still facing their own back yards to maintain privacy from the view of next-door neighbors. Nor does the prior art provide for direct access to light and air and actual spaciousness for individual back yards while at the same time preserving a parallel arrangement of lots and houses for maximum land-use efficiency.

SUMMARY OF THE INVENTION

The present invention offers a salutary configuration of lots with dwellings, garages and yards thereon which engenders distinct benefits. First, all of the dwellings in this invention may have windows which look out on their own back yards while at the same time face in the same direction to take advantage of desirable local conditions such as sunlight exposure. Conversely, when there are adverse local conditions to avoid, all the dwellings in this invention may have their windowless side walls all face the sources of such undesirable conditions as cold prevailing winds and noise. This is made possible by a configuration of two parallel columns of housing lots with the lots and dwellings offset with their back yard neighbor's lots and dwellings. Specifically, each dwelling is placed with one back corner of the dwelling at the back corner of its own lot. One dwelling's side wall defines one side of the next-door neighbor's yard and the rear dwelling wall defines the back yard neighbor's back fence. This configuration allows all the dwellings to have a certain side always face the same direction.

Second, the present invention preserves the privacy of an individual's yard while still allowing access to light and air from directions other than those immediately above the yard, thereby promoting an actual spaciousness. Sunlight and cool breezes can be enjoyed by persons in their own yards while maintaining their privacy without the hemmed-in feelings wrought by dwelling and garage walls and fences completely enclosing the yard. This is achieved by making the back yard neighbor's yard wider than the dwelling's back wall, thereby providing an access to light and air for the back yard which is not blocked by a dwelling or garage wall. Furthermore, there may be passageways between the dwelling and a garage placed at the front of the yard providing conduits for cool breezes, and also allowing easy access to the back yard from the front yard and vice versa.

Third, noise and visual pollution are minimized within the dwellings by (1) disposing certain rooms so that their windows face the lot's own yards, (2) disposing service areas so as to buffer certain rooms from noise, and (3) having absolutely no common dwelling walls with any neighbor.

Fourth, the present invention also provides a means for changing the direction of the columns of lots so as to follow local geographic and environmental conditions without having to alter the design and orientation of the houses on the lots.

The above benefits are achieved while providing land-use efficiency through preservation of a parallel arrangement of columns of lots and the dwellings thereon.

A further understanding of the nature and advantages of the present invention, may be realized by reference to the remaining portions of this application and the attached drawings.

DESCRIPTION OF THE PREFERRED EMBODIMENT

Figure 1B:
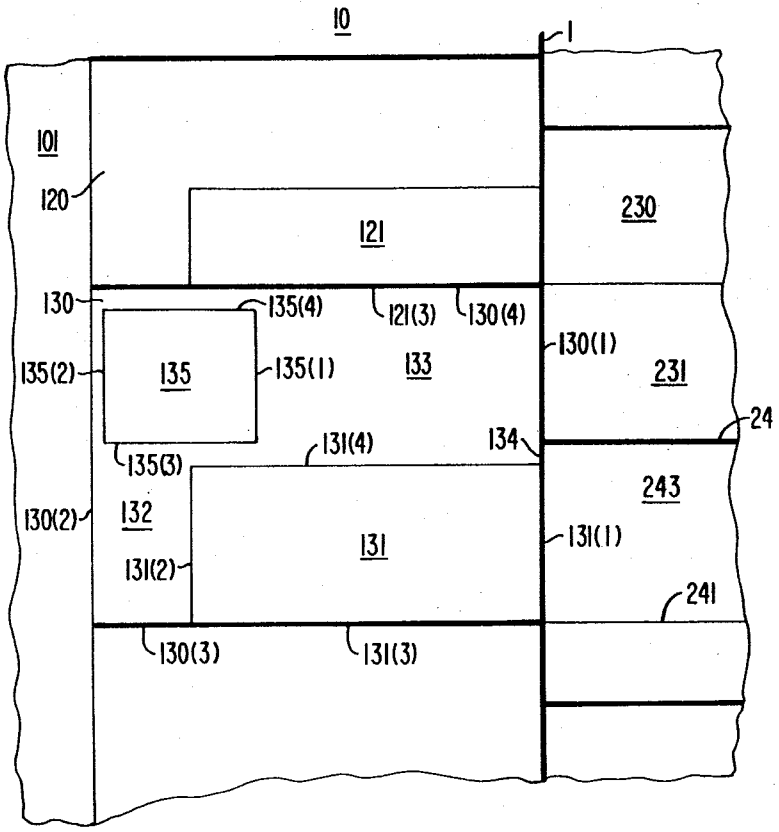
FIG. 1B shows a representative lot and defines its dwelling, garage, and front and back yards in relation to its neighbors.
Figure 1A:
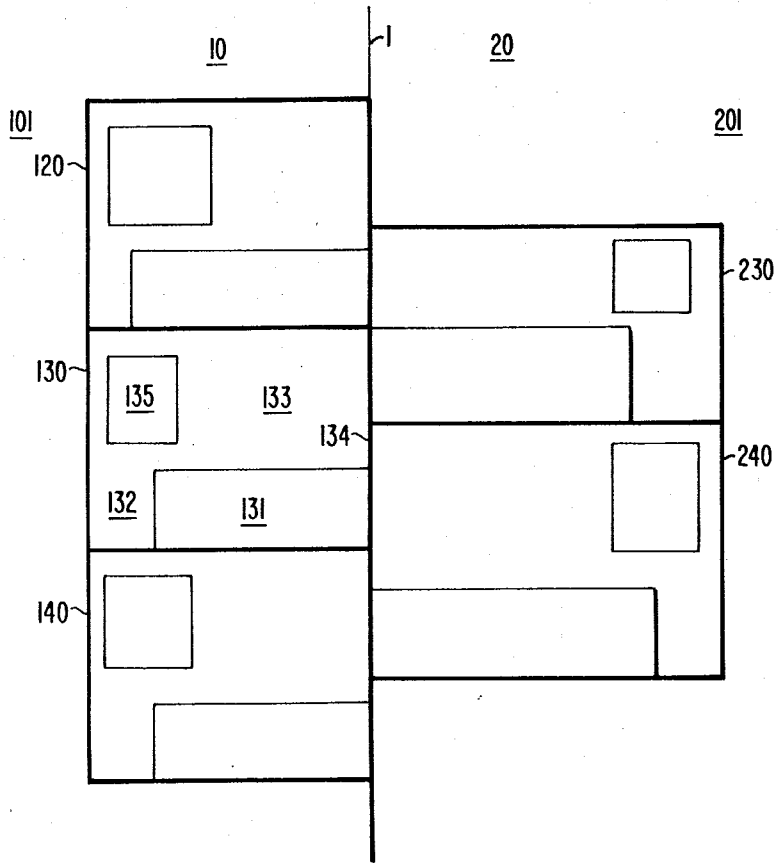
FIG. 1A shows a module of the arrangement of staggered lots in two parallel columns and the positions of dwellings, garages, and yards on the lots.

FIG. 1A shows an embodiment of an arrangement of lots with dwellings, garages, and yards thereon. The present invention can be understood as a module comprising the five contiguous lots shown in FIG. 1A with a "principal lot" being that lot to which the other four lots are contiguous. This module is repeatable, laid end to end, to constitute as large (or as small) an arrangement of lots as is desired. The lots are arranged in two parallel columns with the back edges of the lots abutting each other and the front edges abutting a public street. The lots in each column are not however, in exactly the same row in that there is a "staggering" in the placement of lots contiguous at their back edges. It is this "stagger" which allows all the dwellings to face the same direction and to provide a light and air passage to the back yard unobstructed by dwelling walls while maintaining the land-use efficient parallel columnar arrangement. This concept will become clear in the detailed specification which follows.

In what follows, the nomenclature and numbering scheme will be set forth followed by a description of the configuration of the present invention. As can be seen in FIG. 1A, there is a spine line 1 running between a column 10 on the left hand side and a column 20 on the right hand side. Lots in column 10 abut a generally parallel public street 101 and are numbered in the 100's (120, 130, 140, . . . ); lots in column 20 about a generally parallel public street 201 and are numbered in the 200's (230, 240, . . . ). Dwellings, garages, and yards on the lots are numbered using the first two digits of the lot on which the dwelling, garage, or yard is disposed. For example, lot 130 has a dwelling 131, a front yard 132, a back yard 133, a fence 134, and a garage 135.

Occasional references to direction will be in terms of "upstream" and "downstream" with the top of the figure being considered the upstream end.

Lot 130 and its immediate surroundings are depicted in more detail in FIG. 1B. A given lot has four edges demarking its boundaries. The edges are designated by using the number of the lot in question followed by the number of the particular edge in parentheses. For example, lot 130 is defined as follows: A back edge 130(1) abuts spine line 1 and is coincident with a part of a lot back edge 230(1) of lot 230 in column 20, a front edge 130(2) abuts street 101, and a first side edge 130(3) and a second side edge 130(4) join back and front edges 130(1) and 130(2) respectively to form a generally rectangular lot.

The walls of the dwellings and garages are designated by the number of the dwelling in question and the wall number in parentheses. For example, dwelling 131 is defined as follows: A dwelling back wall 131(1) is colinear with lot back edge 130(1), a dwelling front wall 131(2) generally faces front yard 132 which itself abuts street 101, a dwelling first side wall 131(3) is coincident with lot first side edge 130(3), and a dwelling second side wall 131(4) faces back yard 133 belonging to dwelling 131's own lot 130.

The back yard 133 on lot 130 is defined by the following. Lot back edge 130(1) defines the back edge of back yard 133. Windowless dwelling back wall 231(1) of dwelling 231 provides part of the enclosure for back yard 133 at its back edge. The enclosure on that edge is completed by a back fence 134 which is common with back yard 243 on lot 240. Dwelling second side wall 131(4) forms the downstream boundary for back yard 133. The upstream boundary for back yard 133 is formed by dwelling first side wall 121(3) of dwelling 121 on lot 120 which is upstream from lot 130 in the same column 10. A back yard front edge is defined by a garage back wall 135(1) of a garage 135 on the same lot.

Garage 135 is defined as follows: Garage back wall 135(1) partially encloses back yard 133, a garage front wall 135(2) generally with an opening faces public street 101, a garage first side wall 135(3) at the downstream side of garage 135, and a garage second side wall 135(4) at the upstream side of garage 135 are disposed so as to allow passageways between dwelling 131 and neighboring dwelling 121. Positioning of garage 135 laterally across column 10 is selectable so as to increase or decrease the relative sizes of front yard 132 and back yard 133.

The orientation and positioning of lots, dwellings, garages, and yards make possible certain benefits in the present invention. By proper orientation of the columns of lots. and given the position of the dwellings on the lots, dwelling first side wall 131(3), being generally windowless, can act as a barrier to prevailing cold winds, thereby saving heating costs; or, in hot climates, dwelling first side wall 131(3) can keep the sun out of dwelling 130, thereby saving air conditioning costs. In addition, if there are local conditions of noise or visual pollution in the area, windowless dwelling first side wall 131(3) can also act as a barrier to those undesirable conditions. Dwelling back wall 131(1), which is also generally windowless, affords privacy to back yard 133 from the view of the back yard neighbor on lot 240. Dwelling front wall 131(2), which generally has windows, affords a view of lot 130's own front yard 132 and street 101, and privacy from the view of neighbors is also achieved. Dwelling second side wall 131(4) also generally has windows and the view is of the dwelling's own back yard thereby affording privacy through those windows from the view of neighbors and the public. This housing arrangement also allows multi-story capability if all the houses are approximately the same height. By proper orientation of the columns of lots, dwelling second side wall 131(4) can receive sunlight or breezes through its windows for dwelling 131. Since all the dwellings in the configuration of the present invention can have certain walls all face the same direction, all the dwellings in a housing development employing the present invention can take advantage of desirable local conditions and avoid undesirable local conditions equally.

Another benefit of the configuration in this embodiment of the present invention is that there are absolutely no common dwelling walls at all. This eliminates noise from neighbors through the dwelling walls and is of distinct benefit for closely-packed housing developments.

Still another benefit of this configuration is that if one room, for instance a kitchen, is placed at the intersection of dwelling front wall 131(2) and dwelling second side wall 131(4), then a person in that room can view both front yard 132, street 101, and back yard 133 without leaving the room. This is particularly convenient for families with small children who might play in the yards; parents could watch them conveniently from one room in dwelling 131. Additionally, a kitchen window can be placed on dwelling first side wall 131(3) facing the neighbor's garage side wall. Privacy can be maintained for the neighbor by erecting a tie-in wall connecting dwelling 131 with the neighboring garage side wall. The neighboring back yard then can not be viewed from dwelling 131, while providing an additional kitchen window for, say, ventilation or other purposes.

The positioning of dwelling 131 and garage 135 also provide privacy for back yard 133 while preserving access to light and air and easy accessibility for family members. Since dwelling first side wall 121(3) on lot 120 is generally windowless, back yard 133 achieves privacy from neighbors on this side. Dwelling back wall 231(1) on lot 230 is also generally windowless, thereby providing privacy for back yard 133 on that side from the back yard neighbor. The back edge of back yard 133 has a portion (at back fence 134) which is not blocked off by a dwelling wall, thus sunlight and breezes may enter into back yard 133 from over back yard fence 134. In addition, dwelling back wall 231(1), back fence 134, and neighboring first side wall 121(3) form a continuous structure with dwelling back wall 131(1) and with other neighbors' dwelling back walls, back fences, and dwelling side walls through which community lighting, security systems, and cable TV wires can run. In addition, power lines or the like can be run through the dwelling first side walls, since they abut the spine line, to provide utility lines and the like to the neighboring back yards. By disposing such lines during construction there will be considerable cost savings gained from avoiding digging to place underground lines or tearing down existing walls. All manner of appliances, such as lights, speakers, utilities, and the like, controllable from inside the house, can be attached to these lines. The front edge of back yard 133 is partially enclosed by garage back wall 135(1) of garage 135. In this embodiment of the present invention, passageways are provided from front yard 132 to back yard 133 between dwelling 131 and garage 135 and between dwelling 121 on lot 120 and garage 135. This allows not only light and air to enter back yard 133, but also allows access to back yard 133 by, for example, the resident family's children who do not have to go through either dwelling 131 or garage 135 to reach back yard 133 from front yard 132 and vice-versa. By making the passageways narrow, privacy for back yard 133 is maintained. Fences may also be placed at the passageways for greater security if desired. Also, if an opening is provided in garage back wall 133(1), vehicles may be moved through the garage to the back yard if desired.

Thus the back yards in this embodiment of the present invention achieve privacy by having upon it only a view from a dwelling on its own lot and by having an almost complete enclosure provided by neighbors' windowless walls and its own garage back wall. This privacy allows each family to develop its own landscaping and architectural personality in the back yard. At the same time, light and air are accessible to the back yard through passageways between the garage and the dwelling on the lot and over the back fence in the back of the yard. Back yards in this configuration are generally made larger than front yards, but this is flexible. The advantage of smaller front yards is that there will be less maintenance required to meet neighborhood community requirements.

Figure 2:
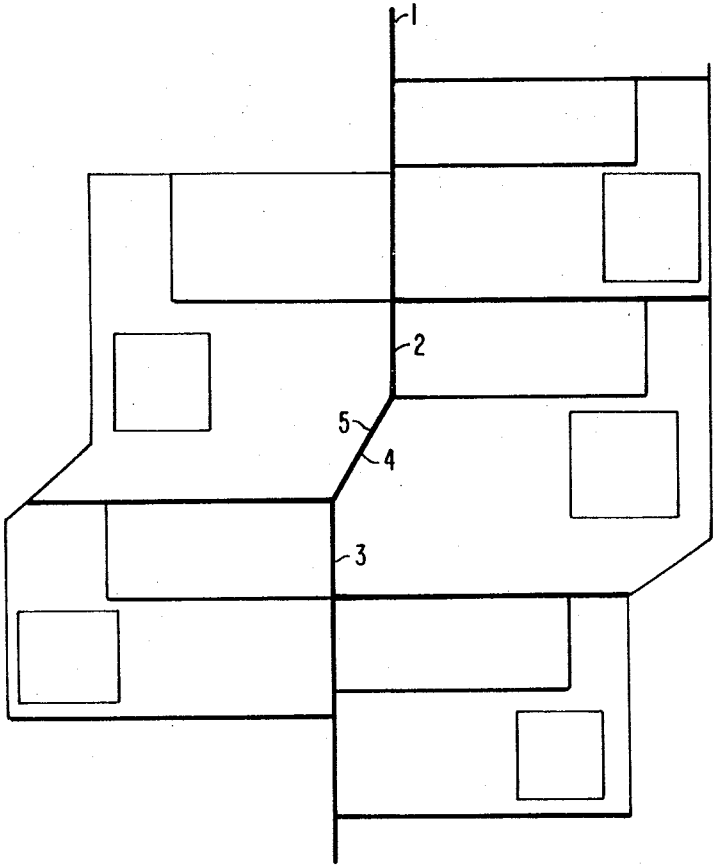
FIG. 2 shows the spine line offset feature which allows the columns on which the houses are disposed to change direction while preserving the orientation of the dwellings.

FIG. 2 shows an alternate embodiment of the present invention wherein the spine line is offset such that a first spine line segment 2 is joined to a second parallel but non-collinear spine line segment 3 by a tie-in 4. This allows the columns of lots to change their direction in order to meet the particular geographic or environmental conditions of the area while maintaining the orientation of the lots and dwellings. For instance, the offset produced by the configuration of spine line segments 2 and 3 allows the real estate developer to plan the housing development to follow streams and highways and the like. By constructing a fence 5 along tie-in 4, the developer can maintain the privacy of the back yards and at the same time change the columnar direction of the housing development without changing the orientation or architectural design of the dwellings, thereby greatly reducing costs.

Figure 3:
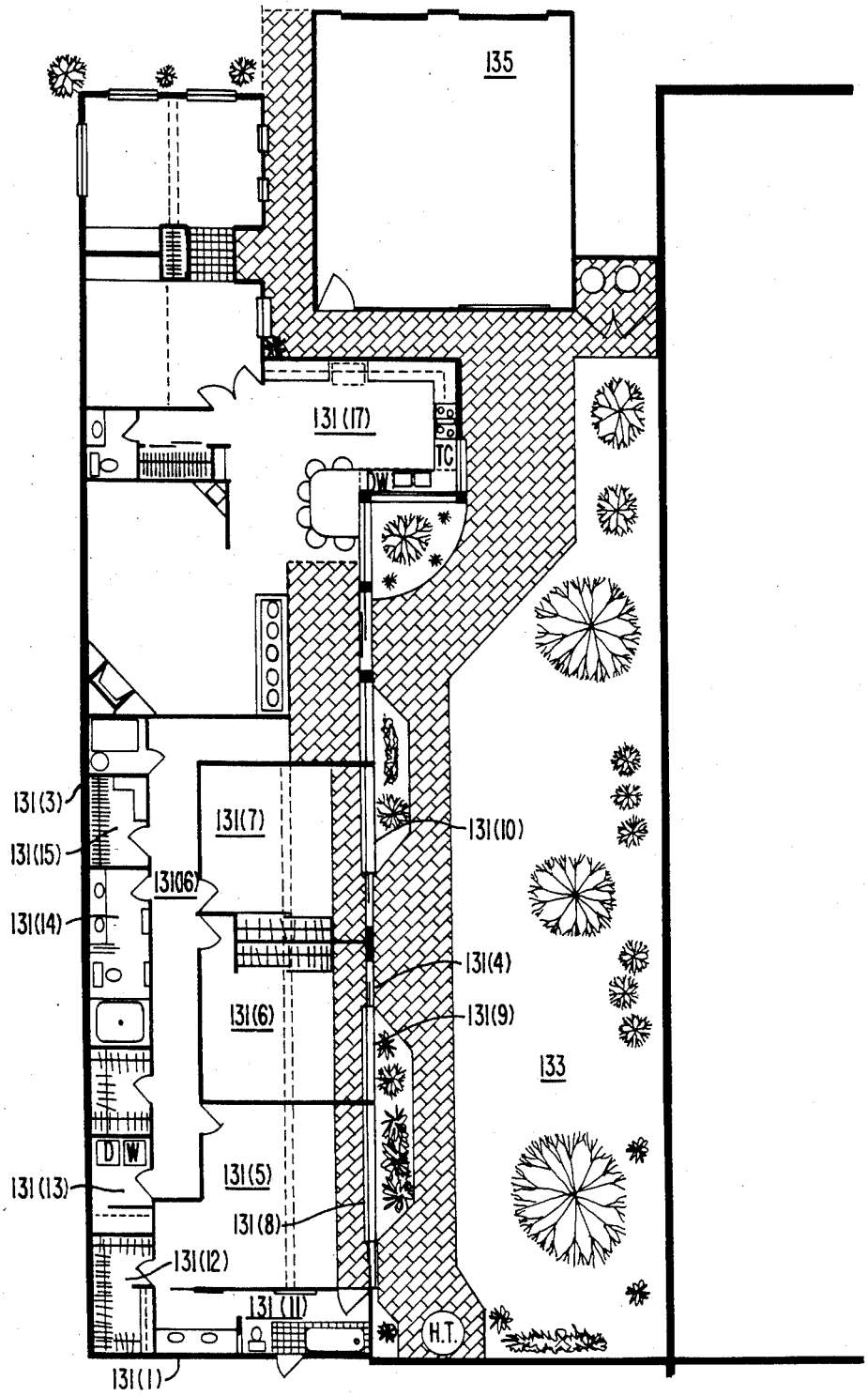
FIG. 3 shows an embodiment of a floor plan which might be used in the dwellings in this housing arrangement, particularly demonstrating noise buffering and kitchen placement.

FIG. 3 shows an embodiment of a floor plan for dwelling 131 disposed on one of the lots of the housing arrangement of the present invention. A master bedroom 131(5) and bedrooms 131(6) and 131(7) are disposed with dwelling second side wall 131(4) and windows 131(8), 131(9), and 131(10) facing back yard 133 thereby providing privacy from neighbors for the bedrooms while allowing light and air to enter the bedrooms through the windows. The orientation capability of this housing arrangement makes it possible to effectively and uniformly use passive solar devices such as thermal storage floors and walls in the houses to save on energy costs. These would be placed in positions to receive solar energy most effectively and could be used in every house because the houses all can face in the same direction. A bathroom 131(11) is disposed between master bedroom 131(5) and dwelling back wall 131(1) thus serving as a noise buffer for master bedroom 131(5). A closet 131(12) and storage room 131(13) are disposed along dwelling first side wall 131(3) thereby buffering master bedroom 131(5) from noise coming through first side wall 131(3). A bathroom 131(14), storage room 131(15) and hall 131(16) also serve to buffer bedrooms 131(6) and 131(7) from noise through first side wall 131(3). Thus all the bedrooms in this configuration are buffered from noise from neighboring lots while still open for light and air from their own lot's back yard.

A kitchen/dining nook 131(17) is placed so that a person in kitchen/dining nook 131(17) may view both the front and back yards without leaving the room. As stated previously, this is particularly convenient for families with small children.

Figure 4:
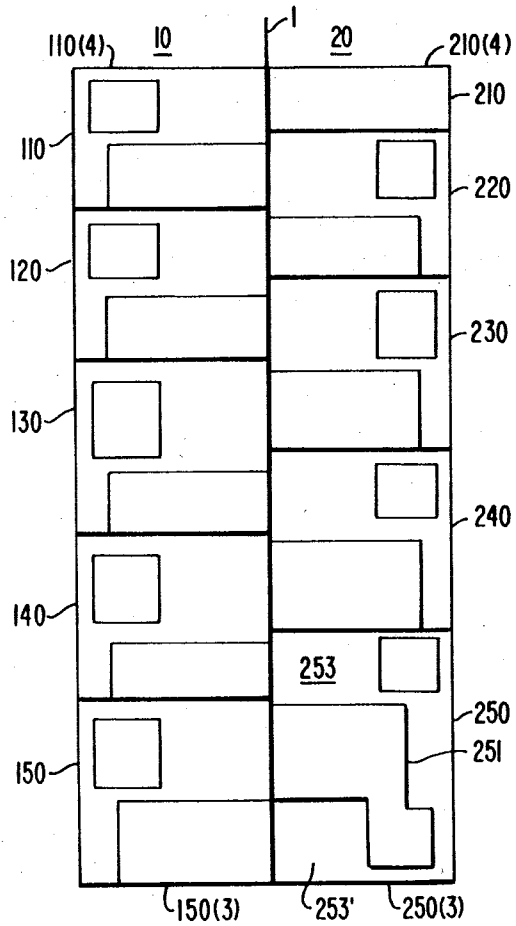
FIG. 4 shows alternative configurations for the end lots in this housing arrangement.

FIG. 4 shows an embodiment of a configuration of end lots for the present invention. Of course in an arrangement of staggered lots such as that presented here, there can be different designs of the lots and dwellings at the ends of the columns of lots. If it is desired to have an even edge at the top or bottom of the columns of lots, this can be achieved in the manner shown in FIG. 4. At the top of the column, lot 210 is made into a public area for use as a children's playground, public flower garden, tennis court, swimming pool, or the like. Lot 210 has its second side edge 210(4) flush with lot second side edge 110(4) in column 10 so that there is an even edge at the top of the columns of lots. Alternatively, as can be seen at the bottom of the columns of lots in FIG. 4, a bigger lot 250 is placed so as to have two back yards 253 and 253'. Lot 250 is of such size as to have first side edge 250(3) flush with lot 150's first side edge 150(3) thereby producing an even boundary for the columns of lots. Since dwelling 251 has yards 253 and 253' on both sides, its architectural design may be different from the other dwellings to take advantage of the two yards. For instance, there could be windows in both dwelling side walls. The yards could also serve different functions as, for example, one yard could include a tennis court or swimming pool or the like. Indeed, the building on enlarged lot 250 need not be a dwelling, but rather it could be a communal recreation facility or the like.

In conclusion, in this embodiment of the present invention, the parallel columns, the placement of lots in staggered rows on both sides of the spine line and the ability to change the direction of the columns of lots provide optimum land-use efficiency. The configuration allows the developer to place a maximum number of lots on the land provided, to follow the environmental contours of the locality, to generally, but not completely, enclose the back yards of each individual lot, to build public use areas or larger lots at the ends of the configuration, and, by means of the staggering of the lots, to have all the dwellings face in the same direction. This means that the home owners will have lower prices to pay for the lots; they will have privacy in their houses and yards, spaciousness, bedrooms buffered from noise, rooms where they can watch over both yards, and areas for public use and enjoyment. Furthermore, the residents will have the benefit of housing arrangements which can take advantage of favorable local conditions of sunlight and breezes, and avoid undesirable local conditions of cold winds, noise, and visual pollution.

While the above description provides a full and complete description of the preferred embodiments of the present invention, various modifications, alternate constructions and equivalents may be employed. Therefore, the above description and illustrations should not be construed as limiting the scope of the invention which is defined by the following claims.

I claim:

1. A housing arrangement comprising:

a first column of N1 lots and a second column of N2 lots, said first and second columns being disposed on opposite sides of a spine line, each lot being defined by a front edge, a rear edge, and first and second side edges;

the lots in said first column being contiguously arranged with the rear edge of each lot along said spine line, and with the first side edge of each of lots numbered 1 through (N1−1) coincident with the second side edge of the adjacent higher-numbered lot, thereby defining a first plurality of (N1−1) common side edges;

the lots in said second column being contiguously arranged with the rear edge of each lot disposed along said spine line, and with the first side edge of each of lots numbered 1 through (N2−1) coincident with the second side edge of the adjacent higher-numbered lot, thereby defining a second plurality of (N2−1) common side edges;

each of said first plurality of common side edges meeting said spine line at an intermediate point of the rear edge of a corresponding lot in said second column, thereby defining a staggered configuration for said first and second columns;

each lot having thereon a dwelling including a front wall, a rear wall, and first and second side walls;

each dwelling having its rear wall along the rear edge of its respective lot;

each dwelling on lots numbered 1 through (N1−1) of said first column and lots numbered 1 through (N2−1) of said column having its first side wall along the first side edge of its respective lot and its second side wall facing a yard area located its on respective lot, whereupon all the dwellings on lots numbered 1 through (N1−1) of said first column and lots numbered (N2−1) of said second column face their respective yard areas in the same direction.

2. The arrangement of claim 1 wherein at least some of said dwellings are configured substantially without windows along their first side walls and rear walls.

3. The arrangement of claim 1 wherein the rear walls of said dwellings are sized relative to the rear edges of said first and second columns of lots so that the rear walls of said dwellings do not overlap along said spine line.

4. In a housing arrangement having a first plurality of contiguous lots arranged in first and second parallel columns, which lots are bounded by back and front edges and first and second side edges, the back edges of each of the lots abutting a common spine line, the front edges of each of the lots abutting public streets running generally parallel to the columns, the lots having dwellings thereon, each having back and front walls and first and second side walls, the five-lot subcombination comprising:

three lots in the first column with a principal lot contiguous at its side edges with a side edge of each of the other lots in that column;

two lots in the second column, contiguous with each other along a common side edge;

the lots in the second column being contiguous at portions of their back edges with the principal lot along portions of its back edge and being contiguous at remaining portions of their back edges with the other lots in the first column along portions of their back edges so as to define a staggered configuration;

respective dwellings on the lots, each dwelling positioned so as to have its first side wall disposed along the first side edge of its respective lot, its back wall disposed along the back edge of its respective lot, its second side wall facing a yard area on its respective lot;

the dwellings being configured so that their first side walls and their back walls are generally solid, thereby rendering them capable of defining at least a portion of the boundary of the yard areas on neighboring lots;

the second side walls being formed with windows opening out on to the respective yard areas on their own lots, said second side walls all facing the same direction.

5. The subcombination of claim 4 wherein:

the dwellings include bedrooms disposed along the dwelling second side walls so that windows in the bedrooms in a given dwelling face the yard areas of that dwelling's respective lot; and the dwellings include bathrooms, closets, and storage areas disposed along the dwelling back walls and dwelling first side walls so as to form a buffer against noise through those walls.

6. The subcombination of claim 4 wherein the dwellings' back walls are sized relative to the lot back edges so that there are no common walls between the dwellings along the spine line.

7. The subcombination of claim 4 wherein the dwellings are multi-storied.

8. The subcombination of claim 4 wherein the spine line is a straight line.

9. The subcombination of claim 4 wherein segments of the spine line are not collinear so as to allow a change in the direction of the columns of lots while preserving the orientation of the lots and the dwellings thereon.

* * * * *